United States Patent [19]

Knapp et al.

[11] 4,269,262

[45] May 26, 1981

[54] ELASTIC MOUNTING STRUCTURE FOR CERAMIC REGENERATOR CORE

[75] Inventors: Charles A. Knapp, Grosse Pointe Woods; V. Durga N. Rao, Bloomfield Hills, both of Mich.

[73] Assignee: Ford Motor Company, Dearborn, Mich.

[21] Appl. No.: 17,293

[22] Filed: Mar. 5, 1979

[51] Int. Cl.[3] ..... F28D 19/00

[52] U.S. Cl. ..... 165/8; 165/10; 74/443; 29/157.3 R; 156/289; 156/297

[58] Field of Search ..... 165/10, 8; 74/443; 29/157.3 R

[56] References Cited

U.S. PATENT DOCUMENTS

| | | | |
|---|---|---|---|
| 1,785,812 | 12/1930 | Gribben | 74/443 X |
| 4,148,354 | 4/1979 | Rao | 165/10 X |
| 4,151,873 | 5/1979 | Lewakowski | 165/8 |

*Primary Examiner*—Albert W. Davis

*Attorney, Agent, or Firm*—Donald J. Harrington; Frank G. McKenzie

[57] ABSTRACT

A low stiffness elastomer mounting arrangement for a ceramic regenerator core comprising an elastomer cushion between a ceramic, circular regenerator core and a surrounding ring gear, portions of the elastomer being bonded to the interior surface of the ring gear and other portions of the elastomer being bonded to the outer periphery of the ceramic regenerator core, the location of the bonds between the elastomer and the ring gear being tangentially offset with respect to the location of the bonds between the elastomer and the regenerator core, adjacent bonds on the ring gear and on the periphery of the regenerator core being tangentially spaced one with respect to the other, the elastomer forming a load transmitting beam construction that is not bonded to either the ring gear or the core whereby driving forces are transmitted from the ring gear to the core while the elastomer compensates for differential expansion of the ceramic core and the ring gear thus avoiding radial stresses and compression loads on the ceramic core.

4 Claims, 11 Drawing Figures

ELASTIC MOUNTING STRUCTURE FOR CERAMIC REGENERATOR CORE

BRIEF DESCRIPTION OF THE INVENTION

Our invention comprises improvements in a regenerator construction of the type shown in U.S. Pat. Nos. 3,848,663; 3,623,544; 3,525,384 and 3,496,993. These references show a ceramic regenerator core of generally cylindrical construction which is adapted to be mounted in a gas turbine housing for rotation about its geometric axis. The ceramic core is located in the hot exhaust gas flow path and in the relatively cool intake air flow path for the gas turbine combustor. As it rotates, it is adapted to transfer thermal energy from the hot gases to the cool gases. A steel ring gear surrounds the cylindrical, ceramic core; and an elastomeric connection exists between the regenerator ceramic core and the ring gear. The elastomer in regenerator drive constructions of the prior art are simple, solid elastomers that are secured in place between a core and a ring gear and bonded to both throughout the entire circumference of the ceramic core. This construction is capable of transferring radial tension and compressive loads between the core and the ring gear as differential expansion occurs between the core and the ring gear. In some instances this may cause the glass ceramic to crack, thus resulting in premature regenerator core failure during operation, especially in an environment such as a gas turbine engine where thermal cycling is relatively extreme.

The improved construction of our invention makes use of an elastomer that is secured in place at selected locations on the inner periphery of the ring gear and also at selected locations on the outer periphery of the ceramic regenerator core. Sponge rubber inserts or air gaps can be provided between the elastomer and the regenerator core periphery at spaced locations. Corresponding sponge rubber inserts or air gaps can be provided at tangentially spaced locations along the inner periphery of the ring gear, and provision is made for overlapping the air gaps or inserts adjacent the ring gear with respect to the air gaps or inserts adjacent the core surface. This produces a force transmitting bridge or beam at tangentially spaced locations between the ring gear and the periphery of the core which results in compensation for differential expansion rates of the ring gear and the core, thus preventing excessive stress loading of the ceramic material of the core.

In one embodiment of our invention provision is made for overlapping the elastomer bond areas on the inner periphery of the ring gear and the elastomer bond areas on the core in a tangential direction as well as in an axial direction, thus making it possible to produce both axial and radial compliance between the regenerator ring gear and the core, thereby avoiding development of excessive stresses in the ceramic material of the core both in a tangential and an axial direction.

PARTICULAR DESCRIPTION OF THE INVENTION

Figure 1:
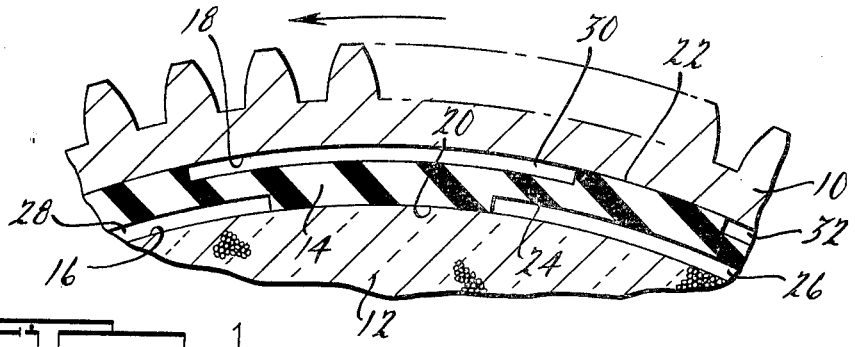
FIG. 1 is a partial view of a rotary regenerator and ring gear construction as seen in the direction of the axis of the regenerator.

In FIG. 1 numeral 10 designates a ring gear for a rotary regenerator. The regenerator comprises a cylindrical core or matrix 12 made of ceramic material. It is provided with axially directed gas flow passages extending from one side of the matrix to the other. These passages form a part of the exhaust gas flow path and the cool intake air flow path for the gas turbine engine when the regenerator is mounted in a regenerator housing portion of a gas turbine engine. This environment is described, for example, in any one of the previously mentioned patents, which are assigned to the assignee of this invention.

An elastomer material 14 is situated between the outer peripheral surface 16 of the ceramic regenerator core and the inner peripheral surface 18 of the ring gear 10. The ring gear 10 is adapted to engage a driving pinion, not shown; and the regenerator core 12 is mounted on its central axis for rotation in a housing. As hot exhaust gases pass through one section of the ceramic core, the core becomes heated. Upon rotation of the heated section, it comes in contact with the relatively cool intake gases passing through the ceramic core in the opposite direction. Thus thermal energy is transferred from the hot gases to the cooler gases to reduce the engine exhaust temperatures and the intake air flow for the engine combuster thereby improving the thermal efficiency of the engine. This thermal energy transfer causes extensive, repetitive temperature reversals in the matrix.

The elastomer 14 is bonded at a first surface section 20 to the outer periphery 16 of the ceramic core. It is bonded also at a surface section 22 on the inner surface 18 of the ring gear 10. The surface section 20 is circumferentially spaced from the surface section 22. The elastomer forms a bridge or load transmitting beam 24 at a location between the surface section 20 and the surface section 22. This pattern is repeated throughout the periphery of the core 12.

The elastomer is spaced from the core at tangentially spaced positions to provide a gap as shown at 26 and 28 adjacent the surface of the core. Similarly, the elastomer is spaced from the internal surface of the ring gear at tangentially disposed positions to provide air gaps as shown at 30 and 32. These gaps may be filled with a soft rubber sponge filler during the fabrication of the regenerator core. One edge of a gap 30 overlaps the adjacent end of a gap 26. The opposite end of gap 30 overlaps the adjacent end of gap 28. This overlapping relationship exists throughout the circumference of the regenerator core.

The gaps may be formed by soft rubber sponge pads which are bonded to the inner surface of the ring gear and the outer surface of the core prior to the injection of the elastomer 14.

Figure 2:
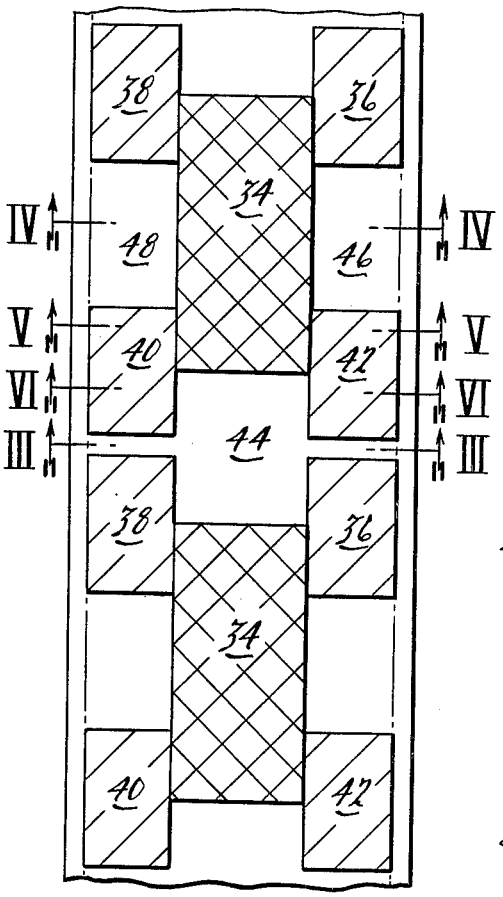
FIG. 2 is a view of an embodiment of our invention that is capable of providing both axial and tangential compliance. It shows the disposition of the soft rubber sponge inserts or fillers between the ring gear and the ceramic core.
Figure 3:
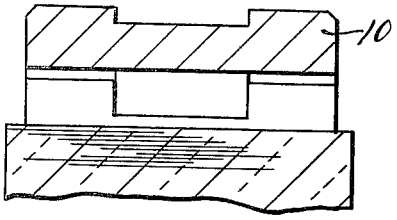
FIG. 3 is a cross-sectional view of the regenerator construction of FIG. 2 as seen along the plane of section line 3—3 of FIG. 2.
Figure 4:
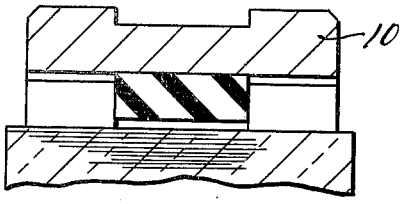
FIG. 4 is a cross-sectional view of the FIG. 2 construction as seen from the plane of section line 4—4 of FIG. 2.

In FIG. 2 we have shown the disposition of the sponge pads between the ring gear and the core. In FIG. 2 the sponges are viewed in a radial direction.

Each sponge comprises a center portion 34 and four side portions 36, 38, 40, 42. Each portion 34 through 42 is of generally rectangular construction. The side portions 36, 38, 40 and 42 overlap a part of the center portion. The sponges are situated in end-to-end relationship as shown, thereby defining tangentially spaced gaps 44 near the midpoint of the axial width of the regenerator core. The sponges define also gaps or spaces 46 and 48 near each side of the regenerator core. Spaces 46 and 48 are tangentially positioned or spaced from the gaps or spaces 44.

Figure 5:
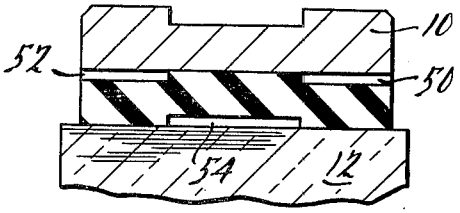
FIG. 5 is a cross-sectional view as seen from the plane of section line 5—5 of FIG. 2.
Figure 6:
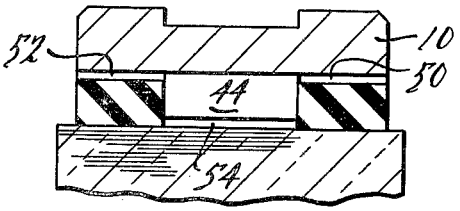
FIG. 6 is a cross-sectional view as seen from the plane of section line 6—6 of FIG. 2.

As seen in FIGS. 3, 4, 5 and 6, the side portions 36, 38, 40 and 42 are offset radially with respect to the center portions 34. This provides a gap between the side portion 42 and the ring gear as shown at 50 in FIG. 5. A corresponding gap 52 is between the side portion 40 and the ring gear 10. Also as seen in FIG. 5 the center portion 34 is radially offset with respect to the core 12 to provide a gap 54. The gap or space 44 near the center of the core is in communication with the gap or space 48 near the edge of the core through the space 52. Similarly, the gap or space 44 is in communication with the gap or space 46 through the space 50. Similarly, the space 44 communicates with the spaces 46 and 48 through the gap 54.

In each of the embodiments shown in FIG. 1 and in FIGS. 2 through 6 the sponge pads are bonded to the surface of the ceramic and to the surface of the ring gear following preparation steps that subsequently will be described. The ring gear then is assembled over the ceramic core, and the elastomer is injected into the space between the ring gear and the core, thereby filling the gaps and spaces described with reference to FIG. 1 on the one hand and with reference to FIGS. 2 through 6 on the other hand. In the case of each embodiment the elastomer forms a load transmitting bridge or beam between the sections of the elastomer that are bonded to the ring gear or to the ceramic. The bridge or beam is not bonded to either the ring gear or the ceramic, but it is capable of transmitting tangential forces between the ring gear and the ceramic.

Figure 7:
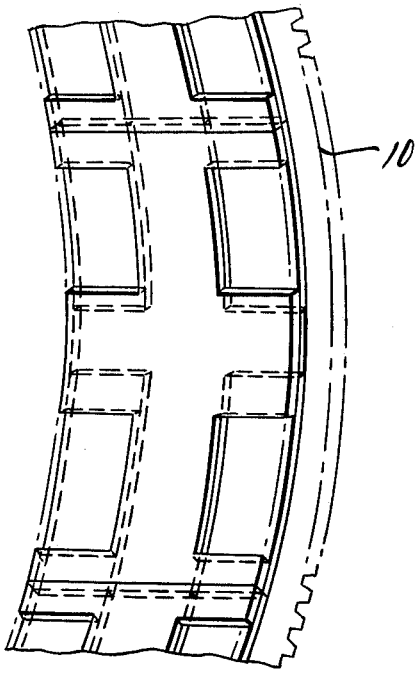
FIG. 7 is an isometric view of a sector of the regenerator construction of FIGS. 2 through 6 showing the relative positions of the soft rubber pads or fillers on the ring gear and on the periphery of the core for another embodiment of our invention.
Figure 7A:
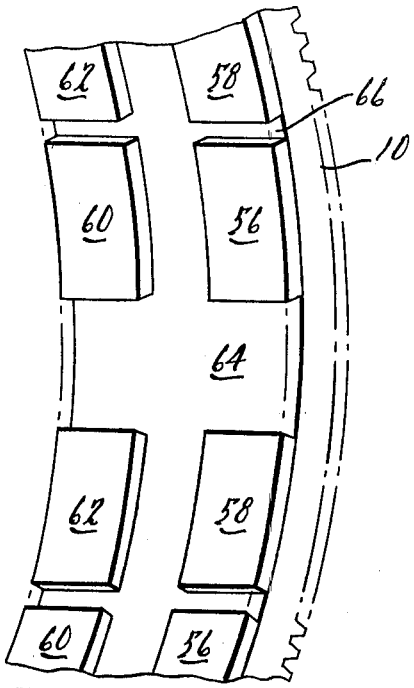
FIG. 7A is an isometric view of the sponge pads for the ring gear of the embodiment of FIG. 7.

In the embodiment in FIG. 7 the ring gear and the pads are secured to separate or distinct pads. The pads on the ring gear are shown in the isometric view of FIG. 7A, and the pads on the periphery of the ceramic core are shown in the isometric view of FIG. 7B. FIG. 7 is an assembly view showing a ring gear, a segment of a ceramic core and pads that are illustrated in FIGS. 7A and 7B.

The pads that are secured to the inner periphery of the ring gear are generally rectangular and are spaced one from the other as shown at 56 and 58 adjacent one axial side of the ring gear 10. Another pair of sponge pads 60 and 62 are disposed adjacent the pads 56 and 58 on the opposite side of the ring gear 10.

The pair of pads 56 and 58 and the pair of pads 60 and 62 are spaced respectively from the next adjacent pairs of pads 56 through 62 to provide a space 64. This space is of greater peripheral extent than the space 66 between adjacent pads 56 and 58 and between adjacent pads 60 and 62.

Figure 7B:
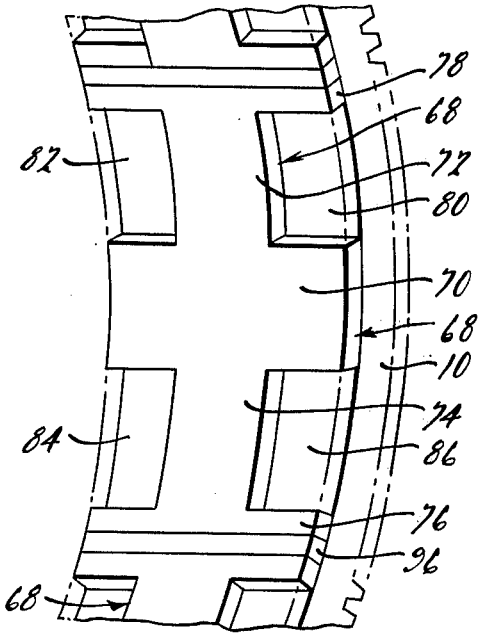
FIG. 7B is an isometric view of the sponge pads for the regenerator core of the embodiment of FIG. 7.

The sponge pads on the periphery of the ceramic matrix are shown in FIG. 7B. They are viewed in FIG. 7B from a vantage point near the axis of the regenerator. The pads are identified by reference character 68, and they are formed with a central portion 70 that has a circumferential thickness that is greater than the circumferential dimension of the space 64. The pads 68 include also tangentially extending narrower portions 72 and 74 extending from either side of the center portion 70. The pads 68 include also end portions 76 and 78, which are arranged in juxtaposed position with respect to adjacent end portions of the adjacent pads 68.

Pads 68 define four spaces 80, 82, 84 and 86 which are arranged, respectively, radially inward and adjacent to the sponge pads 56, 60, 62 and 58 formed on the ring gear.

When the ceramic core is assembled inside the ring gear with the sponge pads attached to each, the elastomer is injected into the spacing between the sponge pads thus providing a resilient, compliant connection between the ring gear and the core. The elastomer thus forms load transmitting bridges or beams between the portions of the elastomer that are bonded to the ring gear and the portions of the elastomer that are bonded to the ceramic.

Figure 8:
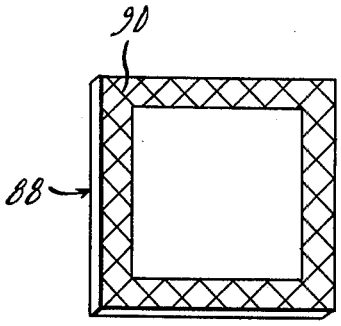
FIGS. 8 and 8A show another embodiment having rectangular, yieldable pads.
Figure 8A:
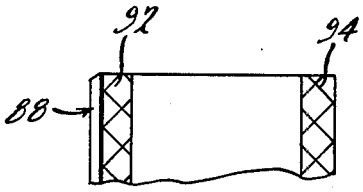

In the embodiment of FIGS. 8 and 8A there are provided rectangular sponge pads that are secured, respectively, to the inner periphery of the ring gear and the outer periphery of the ceramic regenerator. The sponge pads, which are identified in FIG. 8 by reference character 88, are secured to the inner periphery of the ring gear at tangentially spaced locations and corresponding pads 88 are secured to the inner periphery of the ceramic at tangentially spaced locations so that the pads on the ring gear overlap the pads on the ceramic. The pads are attached in each instance around their edges with a room temperature vulcanizing elastomer. The region of the pads where the elastomer bond is applied is shown in FIG. 8 by the shaded area 90. The center of the pad is not bonded to the ring gear or to the ceramic, as the case may be. When the elastomer is injected into the spaces between the pads following assembly of the ring gear over the ceramic core, the elastomer flows around the pads to provide a resilient connection between the ring gear and the ceramic as it becomes bonded to the ceramic, the ring gear and one surface of the pads; but the elastomer does not flow into the inner region of the pads. The pads thus are allowed to stretch when torque is applied to the ring gear, which cushions the transmission of forces between the ring gear and the ceramic.

FIG. 8A shows an alternate method for bonding the pads 88 to the ring gear and to the ceramic. If the width of the pads is equal to or greater than the width of the ring gear, there is no need to provide an elastomer bond on all four edges of the pad. The elastomer bond can be applied, as shown at 92 and 94, only to the edges of the pads that extend in an axial direction. No elastomer injected into the open spaces between the ring gear and the ceramic then will be allowed to flow into the center region of the pad.

FIG. 7B shows radial rim slotting which is done to avoid excessive stresses. The rim slots, which are shown in FIG. 7B by reference character 96, are generally radial slots that are cut into the periphery of the rim with a diamond cutting wheel. The slots in the rim surface, after being cleaned, are filled with an appropriate filler.

The rim surface to which the elastomer is to be bonded should be free of any loose material or grease. The rim is cleaned by means of a filtered, oil-free, compressed air jet followed by degreasing by trichloroethylene.

The surface that is to be coated with bond material should be cleaned by means of a soft wire brush to remove loose material, followed by washing with isopropyl alcohol, and after drying, the bond material should be applied evenly. The coating then should be cured at room temperature for 24 hours or at 250° for one hour in circulating air. A coating known as Carburundum QF180 cement, which is commercially available, has been used successfully.

The elastomer sponge pads are cut from a material that has a temperature capability of at least 50° F., higher than the service temperature of the regenerator. The elastic modulus should be no more than one-tenth of that of the cured elastomer. The compressibility of the sponge should be no less than 50° % of the original thickness. A silicone sponge material has been used successfully for this purpose. A room temperature vulcanizing silicone sealant adhesive, such as RTV-106 manufactured by General Electric, or some suitable material, is used to bond the pads to the ring gear and to the ceramic and then it is allowed to cure for 24 hours. If a shorter curing time is desired, it can be cured at about 200° F. for about two hours.

The ceramic rim portions that are not covered with the pads are coated with a primer to promote adhesion of the elastomer. A compatible primer is X-7706 manufactured by Dow Corning.

The ring gear is prepared for assembly by thoroughly cleaning it by using a wire brush, emery paper or similar device for removing all oxide, loose scale and any extraneous materials. The elastomer compound that is injected can be used also to bond the sponge pads to the gear as well as to the core. The gear internal surface that is not covered with the pads should be allowed to dry completely by holding it in a stream of filtered, oil-free, compressed air for about an hour.

The elastomer compound is comprised of nine parts by weight of a resin compound known as Dow Corning X3-4014, one part by weight of a curing agent such as Dow Corning Q36-061. The mixture is blended. During the blending operation the heat generated should be kept at a minimum by cooling the mixing bowl in a bath or by using some other cooling method. The blended compound preferably should be degassed by placing it in a vacuum chamber. The ring gear and the core then are placed on a supporting fixture and provision should be made for promoting radial growth of the ring gear during heating and for preventing radial growth of the ring gear during heating and for preventing axial movement. The elastomer then is injected into the spaces around the pads and between the ring gear and the core. The elastomer should be injected in layers and built up with a minimum air entrapment. After injection of the elastomer, the gear should be rapidly induction heated to the curing temperature of about 450° F. A curing time of about 20 minutes should be sufficient. The regenerator assembly then is removed from the fixture and transferred to a circulating air oven maintained at 450° F. and held for three hours.

Having described preferred embodiments of our invention, what we claim and desire to secure by U.S. Letters Patent is:

1. A rotary regenerator comprising a cylindrical, ceramic core having axial gas flow passages therein, a metallic ring gear surrounding said core, the inside diameter of said ring gear being greater than the outside diameter of said cylindrical core, said ring gear and said core defining therebetween a circular annular space, and an elastomer drive means between said ring gear and said core in said space and comprising first portions bonded to the inner peripheral surface of said ring gear intermediate but not extending to the axial extremities of the ring gear and second portions bonded to the outer peripheral surface of said core at axially opposite sides of said first portion, said first portions being spaced circumferentially with respect to the second portions, each of said second portions being offset with respect to the adjacent first portion, the surfaces of the elastomer opposite the bond between said gear and said first portions being radially spaced from said core and the surfaces of said elastomer opposite to the bond of said second portions to said core being radially spaced from said ring gear, the elastomer between said first portions and the adjacent second portions being radially spaced from both said ring gear and said core whereby a cushioned, compliant, torque transmitting means is provided between said ring gear and said core.

2. The structure defined by claim 1 wherein the space radially opposite said first portion is occupied by a resilient sponge bonded to said core, the space radially opposite said second portion being occupied by another resilient sponge bonded to said ring gear, said spaces overlapping each other.

3. A rotary regenerator comprising a cylindrical, ceramic core having axial gas flow passages therein, a metallic ring gear surrounding said core, the inside diameter of said ring gear being greater than the outside diameter of said cylindrical core, said ring gear and said core defining therebetween a circular annular space, and an elastomer drive means between said ring gear and said core in said space and comprising first portions bonded to the inner peripheral surface of said ring gear and second portions bonded to the outer peripheral surface of said core, said first portions being spaced circumferentially one with respect to the second portions, each of said second portions being offset with respect to the adjacent first portion, the surfaces of the elastomer opposite the bond between said gear and said first portions being spaced from said core and the surfaces of said elastomer opposite to the bond of said second portion to said core being spaced from said ring gear, the elastomer between said first portions and the adjacent second portions being radially spaced from both said ring gear and said core whereby a cushioned, compliant, torque transmitting means is provided between said ring gear and said core, said first portion and the adjacent second portion being axially spaced one with respect to the other as well as being tangentially spaced, the portion of the elastomer between said first and second portions thereby being capable of transmitting tangential forces as well as axial forces between said ring gear and said core for providing both axial and radial compliance between said ring gear and said core.

4. The structure defined by claim 3 wherein the space radially opposite said first portion is occupied by a resilient sponge bonded to said core, the space radially opposite said second portion being occupied by another resilient sponge bonded to said ring gear, said spaces overlapping each other.

* * * * *